US005346417A

United States Patent [19]

Isogawa

[11] Patent Number: 5,346,417

[45] Date of Patent: Sep. 13, 1994

[54] EXHAUST GAS CLEANING DEVICE FOR OUTBOARD MOTOR

[75] Inventor: Atsushi Isogawa, Hamamatsu, Japan

[73] Assignee: Yamaha Hatsudoki Kabushiki Kaisha, Iwata, Japan

[21] Appl. No.: 23,591

[22] Filed: Feb. 26, 1993

[30] Foreign Application Priority Data

Mar. 6, 1992 [JP] Japan ..... 4-084684

[51] Int. Cl.[5] ..... F01N 3/28

[52] U.S. Cl. ..... 440/89; 60/302

[58] Field of Search ..... 440/89; 60/299, 302, 60/313, 314

[56] References Cited

U.S. PATENT DOCUMENTS

| | | | |
|---|---|---|---|
| 3,500,805 | 3/1970 | Reisacher | 60/312 |
| 3,692,006 | 9/1972 | Miller et al. | 440/89 X |
| 3,967,446 | 7/1976 | Harralson et al. | 440/89 X |
| 5,174,112 | 12/1992 | Sougawa et al. | 440/89 |

FOREIGN PATENT DOCUMENTS

| | | |
|---|---|---|
| 55-10043 | 1/1980 | Japan . |
| 4-39195 | 2/1992 | Japan . |

*Primary Examiner*—Sherman Basinger

*Attorney, Agent, or Firm*—Knobbe, Martens, Olson & Bear

[57] ABSTRACT

A number of embodiments of outboard motors having catalytic exhaust systems. In each embodiment, an expansion chamber is formed in the drive shaft housing and the exhaust gases are delivered to the expansion chamber from an exhaust pipe that extends at least in part through the expansion chamber and which terminates at its lower end in the lower portion of the expansion chamber. A catalyst bed is positioned at the upper end of the expansion chamber and beneath the engine and through which the exhaust gases must pass for discharge through a further exhaust conduit which extends at least in part through the expansion chamber and which terminates at an underwater exhaust gas discharge. Embodiments are depicted with banks of cylinders having exhaust manifolds that are disposed either adjacent each other, in which case the catalyst bed is comprised of two portions disposed transversely outwardly of the exhaust pipes or wherein the exhaust pipes are spaced from each other and the catalyst bed is comprised of two portions disposed transversely from each other and between the exhaust pipes. An embodiment is also shown having an exhaust pipe with a catalyst bed that surrounds it.

28 Claims, 7 Drawing Sheets

EXHAUST GAS CLEANING DEVICE FOR OUTBOARD MOTOR

BACKGROUND OF THE INVENTION

This invention relates to an exhaust gas cleaning device for an outboard motor and more particularly to an improved catalytic treatment for the exhaust gases of an outboard motor.

Because of its compact nature, the design of outboard motors presents a number of problems peculiar to the specific application. The treatment of the exhaust gases in outboard motors is one such example where the design can present numerous problems due to the compact nature of the outboard motor.

With the intention of reducing the pollutants transmitted to the atmosphere from internal combustion engines, it has been proposed to employ catalytic exhaust systems for the outboard motor. These catalytic exhaust systems are particularly important since outboard motors frequently employ two cycle internal combustion engines and such engines may contain a fair amount of lubricating oil along with the other exhaust gas constituents typical with four cycle engines. Thus, catalytic converters are particularly advisable in treating the exhaust gases of outboard motors.

Generally the outboard motor is comprised of a power head in which the internal combustion engine is positioned and that engine has an exhaust manifold that discharges the exhaust gases downwardly into the drive shaft housing through an exhaust pipe. Various forms of silencing devices have been proposed in the drive shaft housing. For the most part, these exhaust systems must be quite compact due to the desire of maintaining a narrow profile for the drive shaft housing and particularly the portions that depends into the body of water in which the outboard motor is operating.

The exhaust gases are also discharged during high speed running through an underwater exhaust gas discharge for added silencing effect. This gives rise to certain problems, particularly when catalytic devices are used in the exhaust system. If any water can find its way back up through the exhaust system and impinge upon the catalyst, fracturing of the catalyst or deterioration of it can readily result.

For this reason, it has been proposed to position the catalytic bed at the upper portion of the drive shaft housing immediately adjacent the power head. With such an arrangement, however, the catalyst has been positioned in the exhaust pipe which delivers the exhaust gases from the engine. However, such positioning of the catalyst can cause restriction to the exhaust gas flow and adversely affect the power of the engine.

In order to avoid this restriction effect and to further protect the catalyst from the water which may enter through the underwater exhaust gas discharge, it has been proposed to provide a system where the exhaust pipe from the engine depends into an expansion chamber and a second exhaust conduit extends in part from the expansion chamber to the underwater exhaust gas discharge. This positioning of the catalyst with the type of constructions previously described has, however, somewhat restricted the size of the catalyst bed and thus problems still exist with this type of arrangement.

Frequently, the engine is also provided with banks of cylinders and for improved exhaust efficiency and exhaust gas tuning, it has been the practice to employ a separate exhaust pipe for each bank. This further complicates the problem of providing effective catalyst area and positioning.

It is, therefore, a principal object to this invention to provide an improved catalytic exhaust system for an outboard motor.

It is a further object to this invention to provide an improved catalytic system for the exhaust gases of an outboard motor wherein the catalyst is positioned where it will not be likely damaged from water entering the exhaust system through the underwater discharge and where the catalytic converter also has adequate cross sectional area to permit effective exhaust gas treatment without raising the exhaust restriction introduced by the catalyst.

It is a further object to this invention to provide an improved catalytic exhaust treatment system for an engine having banks of cylinders and two exhaust pipes.

SUMMARY OF THE INVENTION

A feature of this invention is adapted to be embodied in an outboard motor having a power head including an internal combustion engine having an exhaust port. A drive shaft housing depends from the power head and defines an internal cavity in which an expansion chamber is formed. Art underwater exhaust gas discharge is formed at the lower portion of the lower unit. An exhaust pipe extends from the exhaust port into the expansion chamber and terminates at the lower end thereof for delivering exhaust gases to the expansion chamber. Exhaust conduit means extend from an upper end of the expansion chamber to an underwater exhaust gas discharge for discharging of exhaust gases from the expansion chamber to the atmosphere through the body of water in which the outboard motor is operating. A catalyst bed comprised of at least two portions spaced apart transversely relative to the exhaust pipe is provided and through which the exhaust gases must pass in their path to the underwater exhaust gas discharge.

Another feature of the invention is adapted to be embodied in an outboard motor having a power head including an internal combustion engine with at least two banks of cylinders each having respective exhaust ports. A drive shaft housing depends from the power head and defines an internal cavity in which an expansion chamber is formed. Means define an underwater exhaust gas discharge at the lower end of the drive shaft housing. A pair of exhaust pipes extend from the respective exhaust ports in to the expansion chamber and terminate at their lower ends therein at different vertical positions for delivering exhaust gases to the expansion chamber. Exhaust conduit means extend from an upper end of the expansion chamber to the underwater exhaust gas discharge for discharging exhaust gases from the expansion chamber to the atmosphere through the body of water in which the outboard motor is operating. A catalyst bed is positioned at the upper end of the expansion chamber and through which the exhaust gases passing from the expansion chamber to the exhaust conduit means must pass for treating of the exhaust gases.

DETAILED DESCRIPTION OF THE PREFERRED EMBODIMENTS OF THE INVENTION

Figure 1:
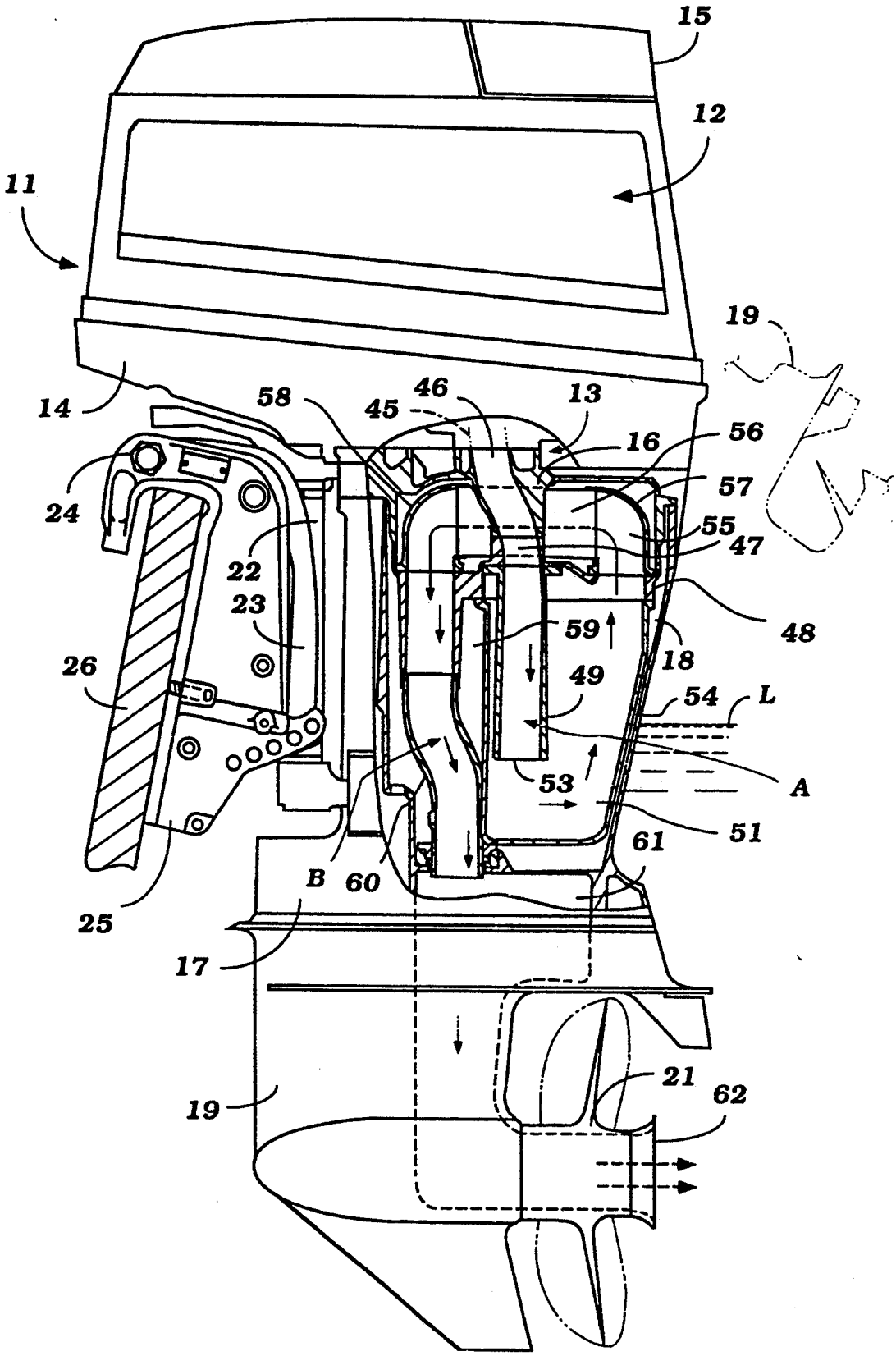
FIG. 1 is a side elevational view of an outboard motor constructed in accordance with a first embodiment of the invention, with portions broken away and shown as attached to the transom of an associated watercraft which is also shown in cross section.
Figure 2:
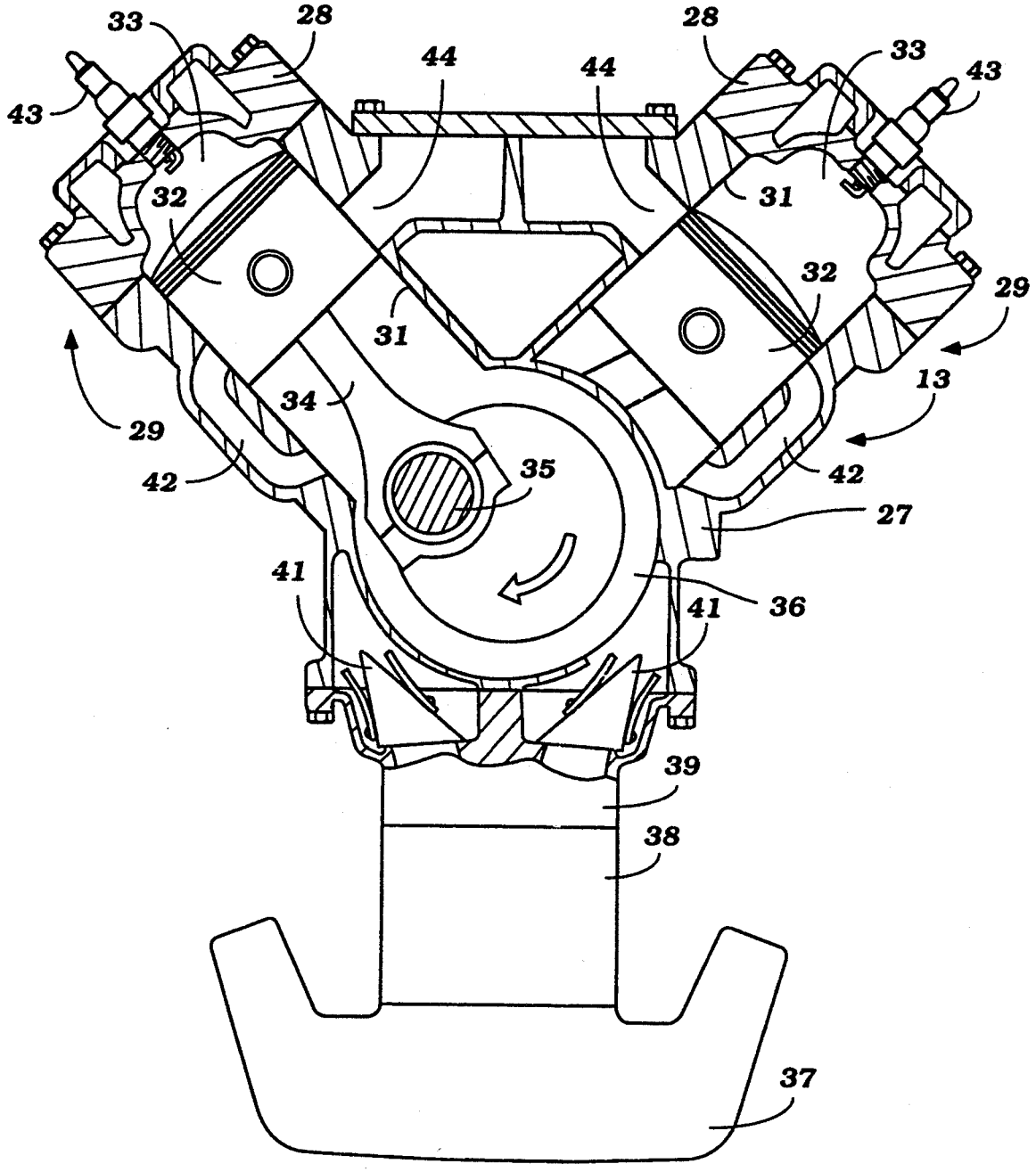
FIG. 2 is a top plan view of the internal combustion engine positioned within the power head of the outboard motor on an enlarged scale, and shown partially in cross section.
Figure 3:
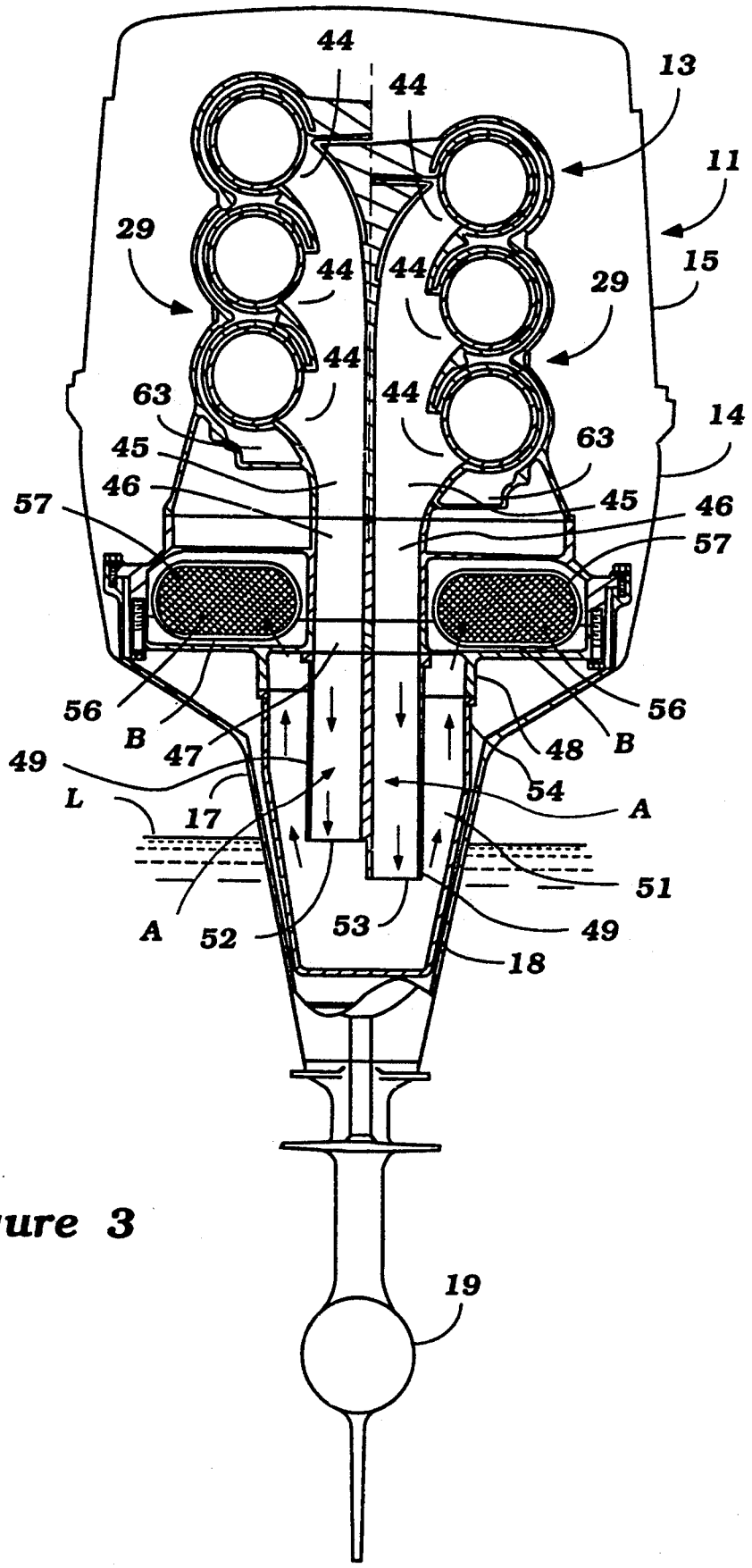
FIG. 3 is a rear elevational view of the outboard motor of this embodiment, with portions broken away and other portions show in section.

Referring now in detail to the drawings and first to the embodiment of FIGS. 1 through 3, an outboard motor constructed in accordance with this embodiment of the invention is identified generally by the reference numeral 11. The outboard motor 11 includes a power head, indicated generally by the reference numeral 12 which is comprised of a powering internal combustion engine 13, of a type which will be described, a surrounding protective cowling comprised of a lower tray portion 14 and a main portion 15 which is detachably affixed to the tray portion 14.

The tray 14 is affixed to a plate 16 which, in turn, is affixed to the upper end of a drive shaft housing, indicated generally by the reference numeral 17. The drive shaft housing 17 is formed as a casting of a light weight material such as aluminum or aluminum alloy and has an enlarged internal cavity 18, for a purpose to be described. A drive shaft (not shown) driven by the engine 13 is journalled in the drive shaft housing 17 and extends into a lower unit 19 fixed to the lower portion of the drive shaft housing 17. A propeller 21 is journalled on a propeller shaft that is driven by the drive shaft through a conventional forward, neutral, reverse transmission (not shown).

A steering shaft 22 is affixed to the drive shaft housing 17 and is journalled within a swivel bracket 23. Rotation of the steering shaft 22 within the swivel bracket 23 accomplishes steering of the outboard motor 11 about a generally vertically extending steering axis, as is well known in this art.

The swivel bracket 23 is, in turn, pivotally connected by a pivot pin 24 to a clamping bracket 25. The clamping bracket 25 is adapted to be affixed to a transom 26 of a watercraft in a known manner. The construction of the outboard motor 11 as thus far described, may be considered to be conventional.

The construction of the internal combustion engine 13 will now be described by particular reference to FIGS. 2 and 3. In this embodiment, the engine 13 is of the V6-type and operates on a two stroke, crankcase compression principal. As will become apparent, certain facets of the invention can be employed in conjunction with engines having other cylinder numbers or cylinder configuration or, for that matter, with rotary type engines. Also, the invention can be employed with four cycle engines. The invention, however, does have particular utility in conjunction with two cycle, crankcase compression engines because of the presence of lubricant in their exhaust gases and also this particular embodiment has particular utility with V-type engines having a type of exhaust system as will be described.

The engine 13 is comprised of a cylinder block 27 having a pair of aligned cylinder banks to which respective cylinder heads 28 are affixed so as to provide the cylinder banks indicating by the reference numerals 29. In the illustrated embodiment, the cylinder banks 29 are disposed at a 90° angle to each other.

Each cylinder bank 29 of the cylinder block 27 is provided with three aligned cylinder bores 31 in which pistons 32 reciprocate. The area above the heads of the pistons 32 and defined by the cylinder bores 31 and cylinder heads 28 form combustion chambers 33 which vary cyclically in volume, as is well known.

The pistons 32 are connected by means of connecting rods 34 to individual throws of a crankshaft 35. The crankshaft 35 is supported for rotation within a crankcase chamber 36 formed by the cylinder block 27 and a crankcase member which is affixed to it in a known manner. As is typical with two cycle engine practice, the portions of the crankcase chamber 36 associated with each combustion chamber 33 are sealed from each other.

An induction system is provided for supplying a fuel-/air charge to the crankcase chambers 36 and in the illustrated embodiment, this induction system includes an air inlet device 37 which draws air from within the protective cowling and specifically through an air inlet opening (not shown) in the main cowling member 15. This air is then delivered to a plurality of carburetors 3S which, in turn, are affixed to an intake manifold 39 that communicates with the individual crankcase chambers 36 through suitable passages and which reed-type check valves 41 are provided. As is well known in this art, the reed-type check valves 41 permit flow of fuel/air mixture into the crankcase chambers 36 when the pistons 32 are ascending in the cylinder bores 31 and close the intake passages as the pistons 32 move downwardly to compress the fuel/air charge in the chambers 36.

The fuel/air charge compressed in the crankcase chambers 36 is then delivered to the combustion chambers 33 through one or more scavenge passages 42 formed in the cylinder block 27 and which communicate with the cylinder bores 31 at a point above the bottom dead center position of the pistons 32.

The fuel/air charge which is transferred to the combustion chambers 33 and further compressed therein is fired by spark plugs 43 mounted in the cylinder heads 28 with their gaps extending into the combustion chambers 33. The spark plugs 43 are fired by a suitable ignition circuit. The gases which burn expand and drive the pistons 32 downwardly.

The exhaust gases are discharged through exhaust ports 44 formed in the cylinder block 27 and which extend in the valley of the V-angle formed between the cylinder banks 29. The exhaust ports 44 of each cylinder bank 29 feed into common collector sections 45 which are formed by exhaust manifolds in the cylinder block 27 and which extend vertically, as is the common practice in two cycle outboard motor practice. The lower ends of the manifold collector sections 45 communicate with exhaust passages 46 formed in the spacer plate 16. At the lower end thereof, the exhaust passages 46 communicate with further exhaust passages 47.formed in a further member that has a skirt portion 48 that depends into the drive shaft housing cavity 18.

A pair of exhaust pipes 49 are affixed to communicate with the lower ends of the passages 47 and deliver the exhaust gases to the lower portion of an expansion chamber cavity 51. It should be noted that the end 52 of one of the exhaust pipes 49 is spaced further above the bottom of the expansion chamber 51 than the end 53 of the other exhaust pipe 49. This tends to reduce the likelihood of objectionable pulses being transmitted back from one exhaust conduit to the other exhaust conduit. The exhaust pipes 49, passages 46 and 47 can be considered to form first conduits A which extend in part into the expansion chamber 51.

The expansion chamber 51 is formed in primary part by a separate sheet metal insert piece 54 that is affixed to the underside of the member which forms the skirt 48. The expansion chamber 51, however, has greater extent that merely the sheet metal member 54. As it may be seen, the expansion chamber 51 has a portion that extends upwardly beyond the skirt 48.

A second conduit B extends in part through the expansion chamber 51 and delivers the exhaust gases to an underwater discharge, as will be described. This second conduit B is comprised of a pair of inlet portions 55 that are disposed on transverse opposite sides of the exhaust pipes 49 that define an open gap between them through which the exhaust pipes 49 extend as clearly seen in FIG. 3 and which face downwardly. The upper end of the conduit portion 55 at each side of the exhaust pipes 49 merges into an enlarged oval cross sectional shape catalyst bed 56 which is surrounded in part by conduit forming portions 57 which form the inlet portions 55. There are provided further conduit portions 58 on the opposite side of the exhaust pipes 49 (FIG. 1) through which the exhaust gases turn again through 90° and then flow through a common passage 59 formed in the member which forms the skirt 48. A further conduit section 60 extends downwardly from this common outlet opening and opens into a further expansion chamber 61 formed at the lower portion of the drive shaft housing 17 and the upper portion of the lower unit 19. This expansion chamber 61 extends to a conventional through-the-hub propeller exhaust gas discharge 62 for discharge beneath the body of water in which the watercraft is operating under high speed operation.

It should be noted when the watercraft is stationary the outboard motor 11 will be more deeply submerged as shown by the water level L in FIGS. 1 and 3. In this condition, the water level is above both the discharge end of the conduit section 59 of the conduit B and the discharge ends 52 and 53 of the exhaust pipes 49. Thus, there could be a risk that water could enter these pipes, particularly when the outboard motor 11 is stationary. However, since the catalyst beds 56 are disposed at the upper extremity of the expansion chamber 51 and immediately below the lower portion of the engine 13, the likelihood that water will reach the catalyst beds 56 are substantially minimized. Also, the exhaust sections formed by the plates 57 and 58 have a trap-like action that will further protect the catalyst beds 56. The catalyst beds 56 because they are positioned transversely outwardly of the exhaust pipes 49, can have a very large effective flow area and thus there will be substantially reduced flow resistance while provided a maximum contact area with the catalyst to treat the exhaust gases. Because of the location of the catalyst beds 56 in the upper portion of the expansion chamber 51 at the rear side thereof, if the outboard motor 11 is laid down on the clamping bracket 25 as is a typical condition, any water in the expansion chamber 51 is not likely to flow into the catalyst beds 56.

As is typical with outboard motor practice, the engine 13 is water-cooled and a portion of the cylinder block cooling jacket appears in FIG. 3 and is identified by the reference numeral 63.

Figure 4:
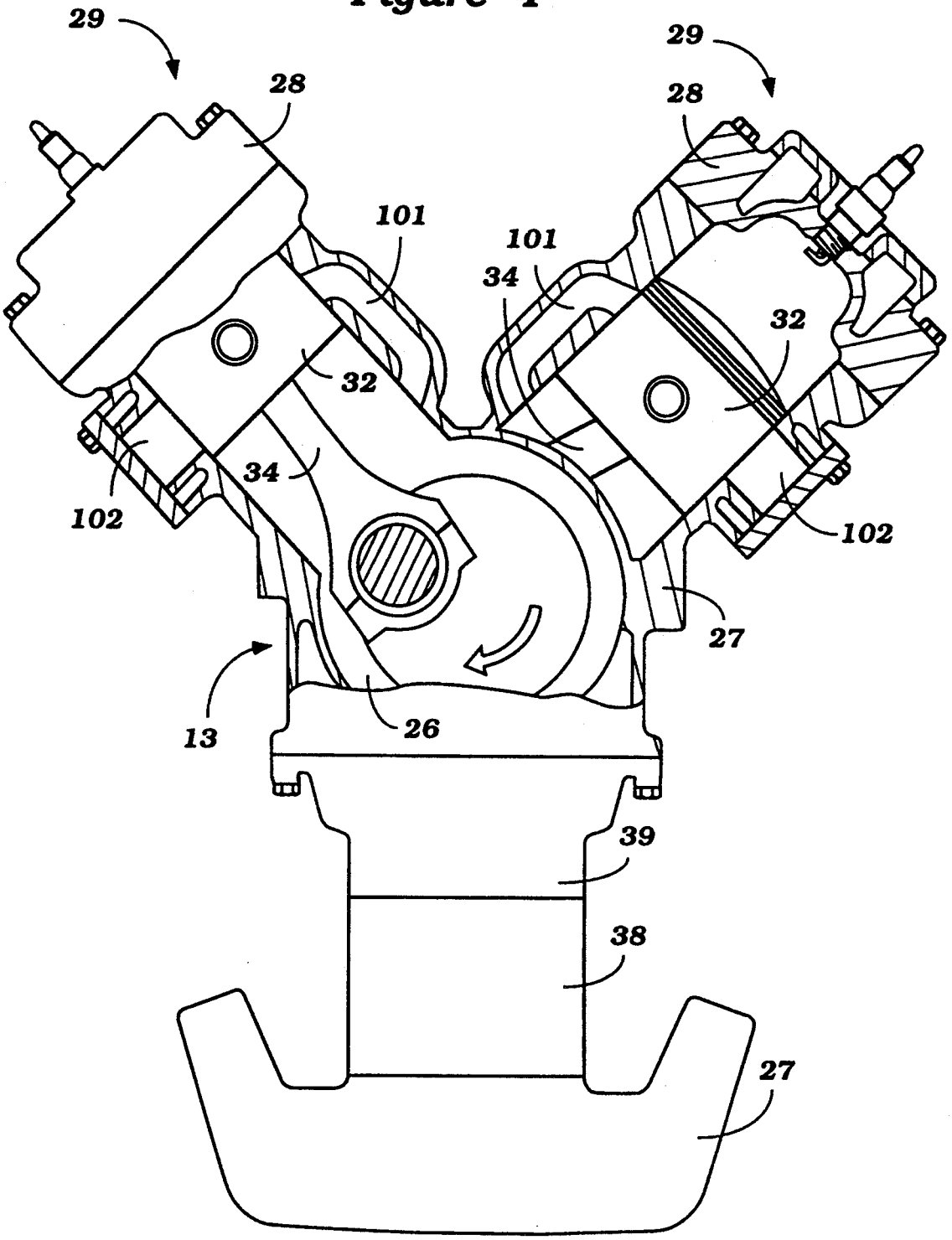
FIG. 4 is a cross sectional view, in part similar to FIG. 2, and shows another embodiment of the invention.
Figure 5:
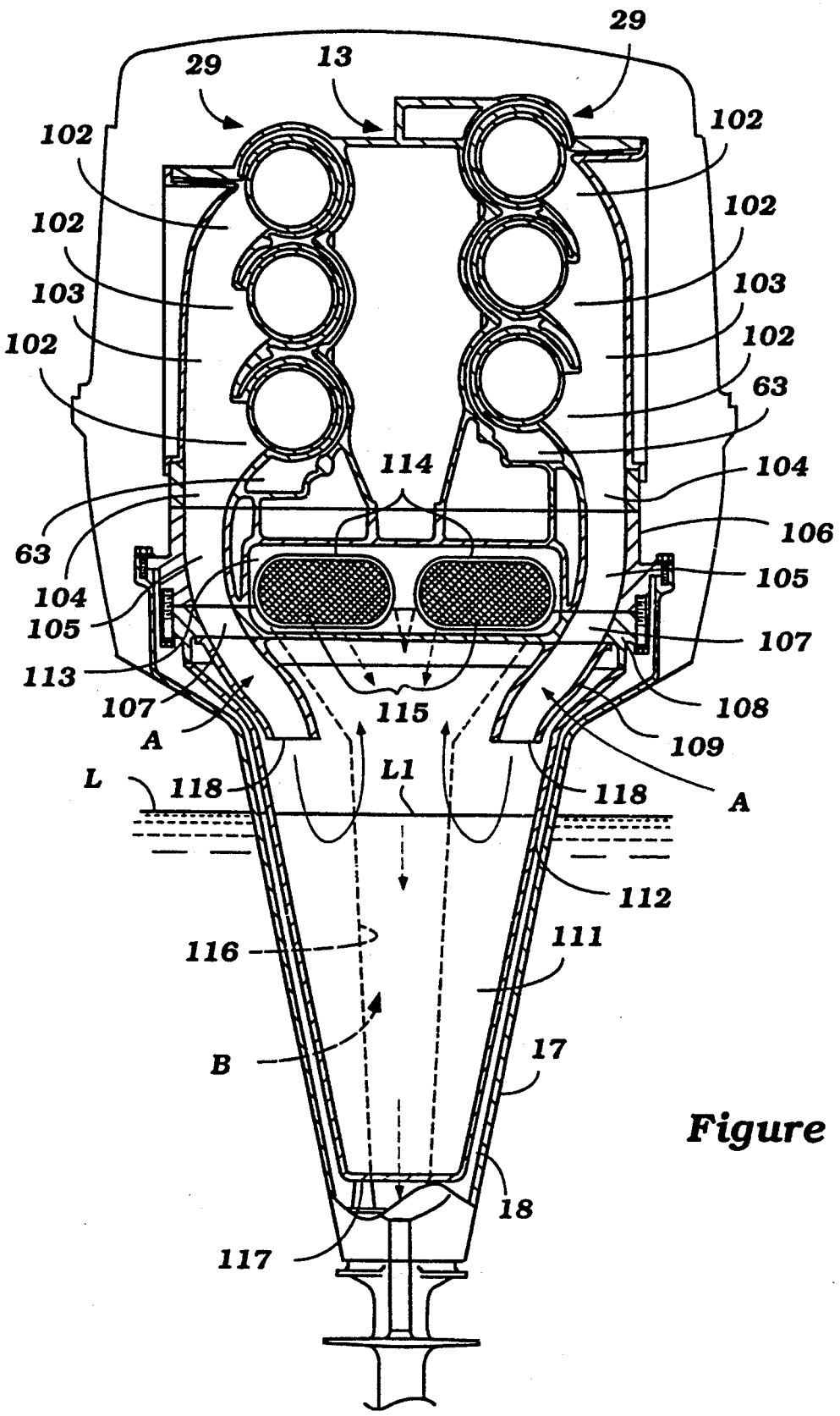
FIG. 5 is a rear elevational view of this embodiment, in part similar to FIG. 3, with portions also broken away and shown in section.

FIGS. 4 and 5 show another embodiment of the invention which differs from the embodiment of FIGS. 1 through 3 only in the location of the scavenge passages and exhaust manifolds in the engine and the resulting changes necessitated in the shape of the conduitry leading to and from the expansion chamber. For that reason, only these different components will be described and those components which are the same as the previously described embodiment have been identified by the same reference numerals.

Referring first to FIG. 4, it should be noted that in this embodiment scavenge passages 101 are positioned in the valley between the cylinder banks 29. As a result, the exhaust ports 102 extending from each of the cylinder banks 29 are disposed on the outer periphery of the cylinder banks 29.

Referring now to FIG. 5, this means that the exhaust manifolds are formed with collector sections 103 that are disposed on the outside of the cylinder banks 29 and which terminate in downwardly facing exhaust outlet openings 104 which communicate with the exhaust conduits A. These exhaust conduits A include first sections 105 formed in a spacer plate 106. The spacer plate sections 105 then communicate with further exhaust sections 107 that are formed in the upper end of a member 108 which is affixed to the underside of the spacer plate 106. Exhaust pipe sections 109 communicate with the lower ends of the openings 107 and extend into an expansion chamber 111 formed by an expansion chamber member 112 that is affixed suitably to the member 108. As with the previously described embodiment, the member 112 extends into a cavity 118 formed by the drive shaft housing 17.

At the upper ends of the expansion chamber 111 there are provided a pair of inlet openings that are transversely spaced apart within a chamber 113 formed by the spacer plate 106 and the plate 108. These inlet openings are identified by the reference numeral 114 and have disposed immediately behind them a pair of transversely spaced apart catalyst beds 115 which are disposed between the exhaust pipes 109 and which define an open gap between them, as clearly seen in FIG. 5. The exhaust gases which flow through the catalyst beds 115 are then delivered to a Y-shaped conduit section 116 which extends downwardly to one side of the expansion chamber forming member 112 and which terminates in communication with an underwater exhaust gas discharge of the type previously described. This discharge conduit is identified by the reference character B as with the previously described embodiment.

In this embodiment, a small weep hole 117 may be seen to be formed at the lower end of the expansion chamber 111 so as to permit any water which may be formed therein to drain back into the body of water in which the watercraft is operating.

It will be noted that the ends of the exhaust pipes 109, indicated by the reference numerals 118 in this embodiment are disposed above the water level L when the outboard motor 11 is stationary and above a corresponding water level L1 which may accumulate in the expansion chamber 111 when the outboard motor 11 is stationary. This further reduces the likelihood of water reaching the catalyst beds 115. Also, this embodiment has the same other protections for preventing water from entering into the catalyst beds 115 when the system is operational and/or when the watercraft is moored or not in motion.

Figure 6:
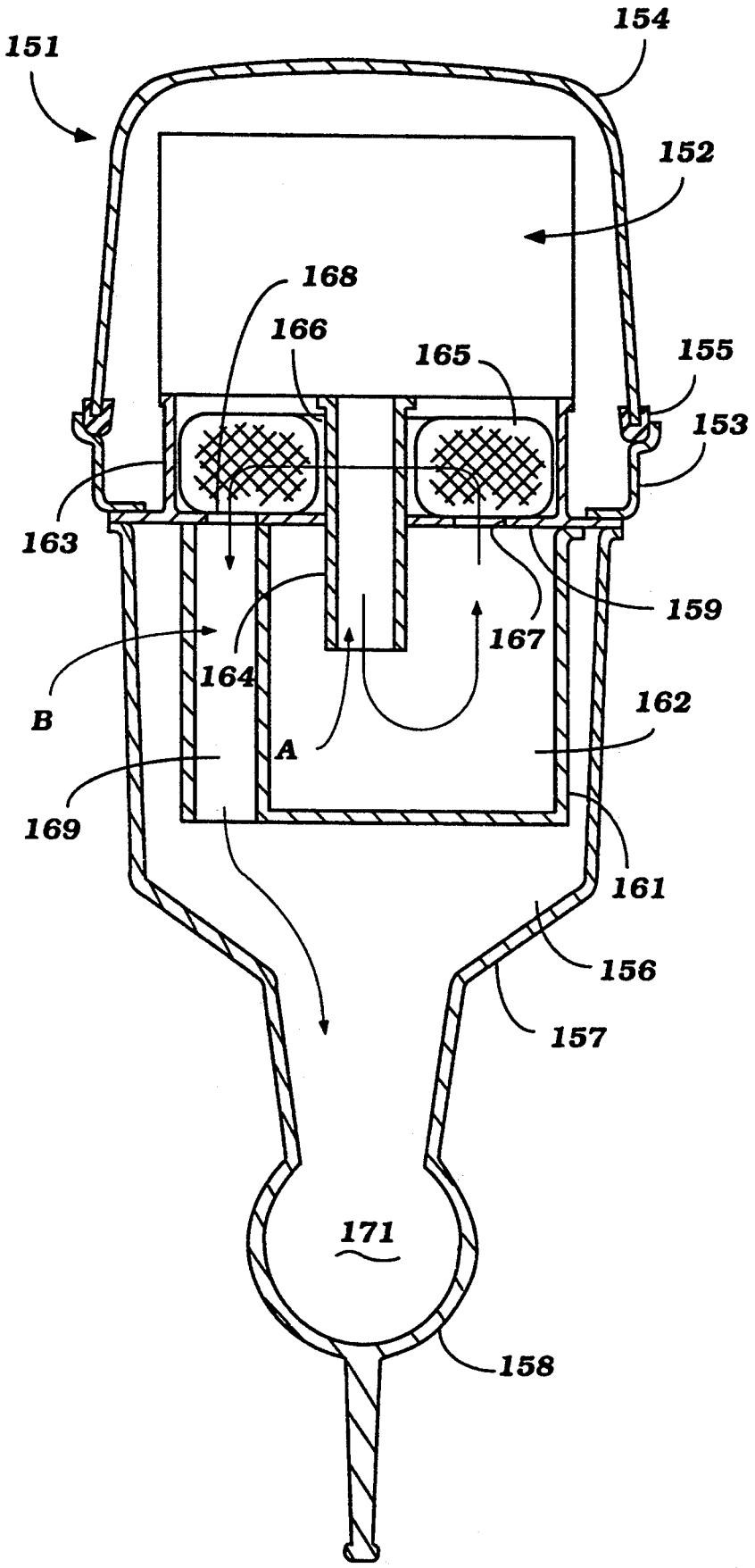
FIG. 6 is a rear elevational view with portions broken away and shown in section of another embodiment of this invention and is in part similar to FIGS. 3 and 5.
Figure 7:
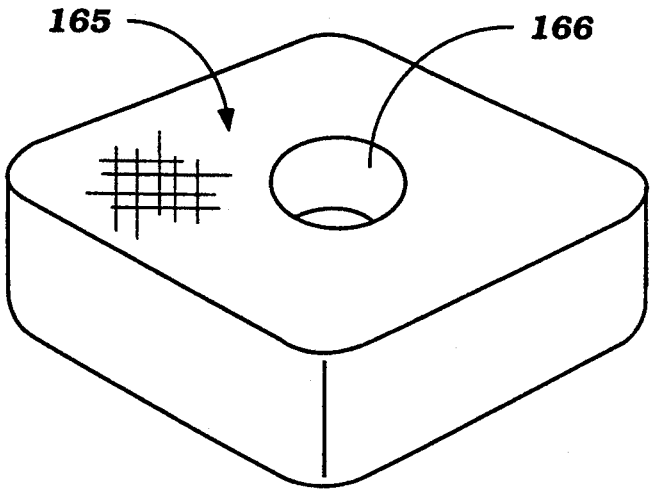
FIG. 7 is a perspective view of the catalyst bed of the embodiment of FIG. 6.

The embodiments of the invention as thus far described have employed engines having cylinder banks each with their own respective exhaust pipes. The invention may also be employed with outboard motors having engines with a single exhaust pipe and FIGS. 6 and 7 show such an embodiment with the outboard motor of this embodiment being indicated generally by the reference numeral 151-. The outboard motor 151 includes a power head that includes an internal combustion engine 152 which may be of any known type but preferably is of the type operating on the two cycle, crankcase compression principal and has an exhaust system with only one exhaust discharge in its lower face. Because of this, it is believed unnecessary to disclose the remaining construction of the internal combustion engine 152.

The power head includes, in addition to the internal combustion engine 152, a protective cowling comprised of a lower tray 153 and a main cover portion 154 that is affixed to the tray with a sealing gasket 155 being interposed between their peripheral edges.

The engine 152 drives a drive shaft (not shown) that depends into the hollow interior 156 of a drive shaft housing 157. This drive shaft then continues on to a lower unit 158 where it drives a propeller (not shown) through a conventional forward, neutral, reverse transmission.

A plate 159 is interposed between the tray 152 and drive shaft housing 157 and supports an expansion chamber forming member 161 which defines an expansion chamber 162 within the drive shaft housing cavity 156. The tray 159 also has an upwardly extending peripheral flange 163. The purpose for this flange 163 will be described.

An exhaust pipe 164 is affixed to the underside of the engine 152 and communicates with its exhaust outlet opening and extends through the plate 159 and into the expansion chamber 162 generally centrally of it and close to its lower end. The exhaust pipe 164 forms the first exhaust conduit A which delivers the exhaust gases from the engine 152 to the interior of the expansion chamber 162.

Received above the plate 159 and within the sleeve 163 is a catalyst bed, indicated generally by the reference numeral 165 and which catalyst bed 165 has a generally cylindrical or square configuration with a central opening or gap 166 which passes the exhaust pipe 164 so that the catalyst bed 165 will surround the exhaust pipe 164 and be positioned immediately above the plate 159.

An exhaust gas opening 167 is formed in the plate 159 at one side of the exhaust pipe 164 so that the exhaust gases may flow upwardly through the opening 167 and enter the interior of the catalyst bed 165. The catalyst bed 165 may be provided with an outer shell that confines the path of exhaust gas flow through it as shown by the arrow in FIG. 6. This will insure complete contact between the exhaust gases and the catalyst bed 165 while providing a substantial flow area that will reduce any restriction to exhaust gas flow. This outer shell of the catalyst bed 165 may be provided with a further opening which registers with a discharge opening 168 also in the plate 159 and which opening 168 matches with a further exhaust conduit portion 169 formed integrally with the expansion chamber forming portion 161 and thus provides an exhaust discharge conduit B which extends at least partially through the expansion chamber 162. These exhaust gases are then delivered to a further expansion chamber 172 formed in the lower unit 158 for discharge through the underwater exhaust gas discharge as in the previously described embodiments.

It should be readily apparent from the foregoing description that the described embodiments of the invention provide very effective catalytic exhaust treatment systems for outboard motors wherein the catalyst bed is provided at the upper portion of the drive shaft housing and immediately beneath the engine and will offer substantially no resistance to exhaust gas flow and still provide a very large effective area or volume through which the exhaust gases flow for treatment. In addition, the catalyst bed is positioned so that it will not be in contact with any water which may enter the exhaust system through the underwater discharge, particularly when the boat or outboard motor is at rest or even when detached from the watercraft and lying down. Furthermore, this system provides very effective treatment for engines having pairs of cylinder banks each with their own exhaust manifolds. Of course, the foregoing description is that of preferred embodiments of the invention and various changes and modifications may be made without departing from the spirit and scope of the invention, as defined by the appended claims.

I claim:

1. An outboard motor having a power head including an internal combustion engine having an exhaust port, a drive shaft housing depending from said power head and defining an internal cavity, means forming an expansion chamber in said internal cavity, means defining an underwater exhaust gas discharge, exhaust pipe extending from said exhaust port into said expansion chamber and terminating at the lower end thereof for delivering exhaust gases to said expansion chamber, exhaust conduit means extending from an upper end of said expansion chamber to said underwater exhaust gas discharge for discharge of exhaust gases from said expansion chamber to the atmosphere through the body of water in which said outboard motor is operating, and a catalyst bed through which exhaust gases must pass in their path to said underwater exhaust gas discharge, said catalyst bed being comprised of at least two spaced apart portions having an open gap therebetween.

2. An outboard motor as set forth in claim 1 wherein the spaced apart portions of the catalyst bed are disposed on opposite sides of the exhaust pipe.

3. An outboard motor as set forth in claim 2 wherein the catalyst bed comprises a pair of separate beds each placed on a respective side of the exhaust pipe.

4. An outboard motor as set forth in claim 3 wherein the exhaust conduit means comprises a common section leading from the catalyst beds to the underwater exhaust gas discharge.

5. An outboard motor as set forth in claim 2 wherein the catalyst bed encircles the exhaust pipe.

6. An outboard motor as set forth in claim 1 wherein the engine has a pair of exhaust ports and a pair of exhaust pipes each extending therefrom into the expansion chamber.

7. An outboard motor as set forth in claim 6 wherein the spaced apart portions of the catalyst bed are disposed on opposite sides of the exhaust pipes.

8. An outboard motor as set forth in claim 7 wherein the catalyst bed comprises a pair of separate beds each placed on a respective side of the exhaust pipes.

9. An outboard motor as set forth in claim 8 wherein the exhaust conduit means comprises a common section leading from the catalyst beds to the underwater exhaust gas discharge.

10. An outboard motor as set forth in claim 7 wherein the exhaust pipes are disposed adjacent each other.

11. An outboard motor as set forth in claim 10 wherein the exhaust pipes terminate at different vertical heights within the expansion chamber.

12. An outboard motor as set forth in claim 11 wherein the catalyst bed spaced apart portions are disposed outwardly of the exhaust pipes.

13. An outboard motor as set forth in claim 12 wherein the exhaust conduit means comprises a common section leading from the catalyst beds to the underwater exhaust gas discharge.

14. An outboard motor as set forth in claim 6 wherein the exhaust pipes are spaced transversely relative to each other.

15. An outboard motor as set forth in claim 14 wherein the catalyst bed portions are disposed between the exhaust pipes.

16. An outboard motor as set forth in claim 15 wherein the exhaust conduit means comprises a common section leading from the catalyst beds to the underwater exhaust gas discharge.

17. An outboard motor having a power head including an internal combustion engine having a pair of exhaust ports, a drive shaft housing depending from said power head and defining an internal cavity, means for forming an expansion chamber in said internal cavity, means for defining an underwater exhaust gas discharge, a pair of exhaust pipes each extending from a respective one of said exhaust ports into said expansion chamber and terminating at the lower end thereof for delivering exhaust gases to said expansion chamber, exhaust conduits means extending from an upper end of said expansion chamber to said underwater exhaust gas discharge for discharge of conduit gases from said expansion chamber to the atmosphere through the body of water in which said outboard motor is operating, and a pair of catalyst beds positioned contiguous to the upper end of said expansion chamber and beneath said engine and through which the exhaust gases from the expansion chamber must pass in their flow through the underwater exhaust gas discharge.

18. An outboard motor as set forth in claim 17 wherein the engine has cylinder banks in which the respective exhaust ports are formed.

19. An outboard motor as set forth in claim 18 wherein the cylinder banks are disposed at a angle to each other and define a valley therebetween.

20. An outboard motor as set forth in claim 19 wherein the exhaust ports are formed outside of the valley of the V.

21. An outboard motor as set forth in claim 20 wherein the beds are each placed on a respective side of the exhaust pipes 22. An outboard motor as set forth in claim 21 wherein the exhaust conduit means comprises a common section leading from the catalyst beds to the underwater exhaust gas discharge.

23. An outboard motor as set forth in claim 19 wherein the catalyst beds are disposed on opposite sides of the exhaust pipes.

24. An outboard motor as set forth in claim 19 wherein the exhaust ports are formed in the valley.

25. An outboard motor as set forth in claim 24 wherein the exhaust pipes are disposed adjacent each other.

26. An outboard motor as set forth in claim 25 wherein the exhaust pipes terminate at different vertical heights within the expansion chamber.

27. An outboard motor as set forth in claim 26 wherein the catalyst beds are disposed outwardly of the exhaust pipes.

28. An outboard motor as set forth in claim 27 wherein the exhaust conduit means comprises a common section leading from the catalyst beds to the underwater exhaust gas discharge.

* * * * *